US005142784A

United States Patent [19]

Lee et al.

[11] Patent Number: 5,142,784

[45] Date of Patent: Sep. 1, 1992

[54] METHOD FOR MAKING A ROLLER ASSEMBLY FOR GRAIN SHELLERS

[75] Inventors: Stanley M. Lee, Tomball; Jimmy C. Terry, Spring; John A. Mrosko, Katy, all of Tex.

[73] Assignee: F.H. Maloney Company, Houston, Tex.

[21] Appl. No.: 685,922

[22] Filed: Apr. 18, 1991

Related U.S. Application Data

[63] Continuation-in-part of Ser. No. 517,578, May 1, 1990.

[51] Int. Cl.[5] ..... B02B 3/02

[52] U.S. Cl. ..... 29/895.21; 29/895.1; 29/895.23; 29/129; 29/132

[58] Field of Search ..... 29/895.1, 895.2, 895.21, 29/895.23, 895.3, 895.32, 129, 130, 132; 99/617, 618, 619, 620; 241/221, 230, 234, DIG. 30; 100/211, 176

[56] References Cited

U.S. PATENT DOCUMENTS

| | | | |
|---|---|---|---|
| 2,005,885 | 6/1935 | Brindley | 29/895.21 X |
| 2,685,548 | 8/1954 | Drozdowski | 154/2.7 |
| 3,626,774 | 12/1971 | Schon | 74/230.3 |
| 3,891,739 | 6/1975 | Lawson | 264/155 |
| 4,416,201 | 11/1988 | Kessler | 101/348 |
| 4,416,201 | 11/1983 | Muller et al. | 165/89 X |
| 4,517,719 | 5/1985 | Okumura et al. | 29/124 |
| 4,576,845 | 3/1986 | Krotchko | 428/36 |
| 4,662,274 | 5/1987 | Nonomiya et al. | 99/620 |
| 4,815,370 | 3/1989 | Collins | 99/618 |
| 4,896,758 | 1/1990 | Hoszowski | 29/129 X |

FOREIGN PATENT DOCUMENTS

| | | | |
|---|---|---|---|
| 539220 | 9/1941 | United Kingdom | 29/895.2 |

*Primary Examiner*—Joseph M. Gorski
*Assistant Examiner*—S. Thomas Hughes
*Attorney, Agent, or Firm*—Lorusso & Loud

[57] ABSTRACT

A method for making a roller sleeve assembly comprising providing a metal sleeve, fixing locking lugs to an interior surface of the metal sleeve, the locking lugs extending radially inwardly of the sleeve, and bonding a flexible sleeve to the exterior of the metal sleeve. The invention further contemplates a method for making a roller assembly comprising sliding the above-described sleeve assembly onto a hub comprising a circular wall with ribs extending normally therefrom, and fixing the locking lugs to the circular wall for locking the sleeve assembly onto the hub.

7 Claims, 4 Drawing Sheets

METHOD FOR MAKING A ROLLER ASSEMBLY FOR GRAIN SHELLERS

CROSS-REFERENCE TO RELATED APPLICATION

This is a continuation-in-part of application Ser. No. 07/517,578, filed May 1, 1990 in the name of Jimmy C. Terry and John A. Mrosko.

BACKGROUND OF THE INVENTION

1. Field of the Invention

This invention relates to grain shelling apparatus and is directed more particularly to a method for making a roller sleeve assembly and a roller assembly for rice milling apparatus of the type having twin rollers.

2. Description of the Prior Art

The rice milling process includes a shelling procedure in which the hull, or husk, is removed from the kernel. The shelling procedure follows cleaning the rough rice and serves to remove the course husk from the kernel by use, in most cases, of a set of rubber sheller rolls.

Rubber-surfaced rolls are disposed in parallel with a desired space therebetween and, in operation, are rotated toward each other as rough rice is fed between them. The rollers act to gently remove the husk, leaving the endosperm substantially intact. Thereafter, the kernel may be further refined.

The roll generally employed includes a cast steel or aluminum hub with a rubber surface. The life expectancy of the roll is relatively short, something on the order of less than 100 hours of operation. When a roll has deteriorated to the point at which it requires replacement, the shelling apparatus must be shut down and the rolls removed and replaced. In view of the short life span for rolls, the "down time" of shelling apparatus is a problem.

Accordingly, it would be beneficial to the industry to have available a roll with an improved life expectancy and with a capability for quick and easy replacement.

SUMMARY OF THE INVENTION

An object of the present invention is, therefore, to provide a method for making a roller assembly in which the milling, or shelling, portions readily may be disassembled from the driving portion and replaced with minimal "down time".

Another object of the invention is to provide a method for making a roller sleeve assembly and a roller assembly having enhanced cooling capabilities, so as to reduce deterioration of the shelling portions and thereby lengthen the time period between replacements of the shelling portions.

With the above and other objects in view, as will hereinafter appear, a feature of the present invention is the provision of a method for fabricating a roller sleeve assembly including the steps of providing a metal sleeve, forming counter sunk recesses in the metal sleeve, inserting flat head screws in the counter sunk recesses with the heads of the screws disposed in the counter sunk recesses in the exterior surface of the metal sleeve, fixing locking lugs to the metal sleeve interior surface by way of the screws, bonding a sleeve of flexible material to the exterior of the metal sleeve, and over the heads of the screws, to provide a laminate sleeve assembly with locking lugs fixed thereto and extending radially inwardly thereof.

In accordance with a further feature of the invention there is provided a method for fabricating a roller assembly including the steps of providing a roller sleeve assembly as described immediately above, and providing a mounting hub comprising a circular wall having ribs extending from the wall and substantially normal thereto, sliding the sleeve assembly onto the ribs, and fixing the locking lugs to the wall, whereby to connect the sleeve assembly to the mounting hub.

In accordance with a still further feature of the invention, there is provided a method for making a roller sleeve assembly having a flexible sleeve of polyurethane, the polyurethane sleeve having a wall thickness of about 0.375–0.5 inch, the assembly having a metal sleeve of a wall thickness of about 0.312 inch, the polyurethane sleeve being bonded to a lengthwise surface of the metal sleeve and being coextensive with the metal sleeve, the wall thickness of the polyurethane sleeve facilitating rapid transfer of heat to the metal sleeve and thence to the atmosphere, during use of the roller sleeve assembly.

The above and other features of the invention, including various novel details of construction and combinations of parts, will now be more particularly described with reference to the accompanying drawings and pointed out in the claims. It will be understood that the particular methods embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention from which their novel features and advantages will be apparent.

In the drawings.

DESCRIPTION OF THE PREFERRED EMBODIMENT

Figure 1:
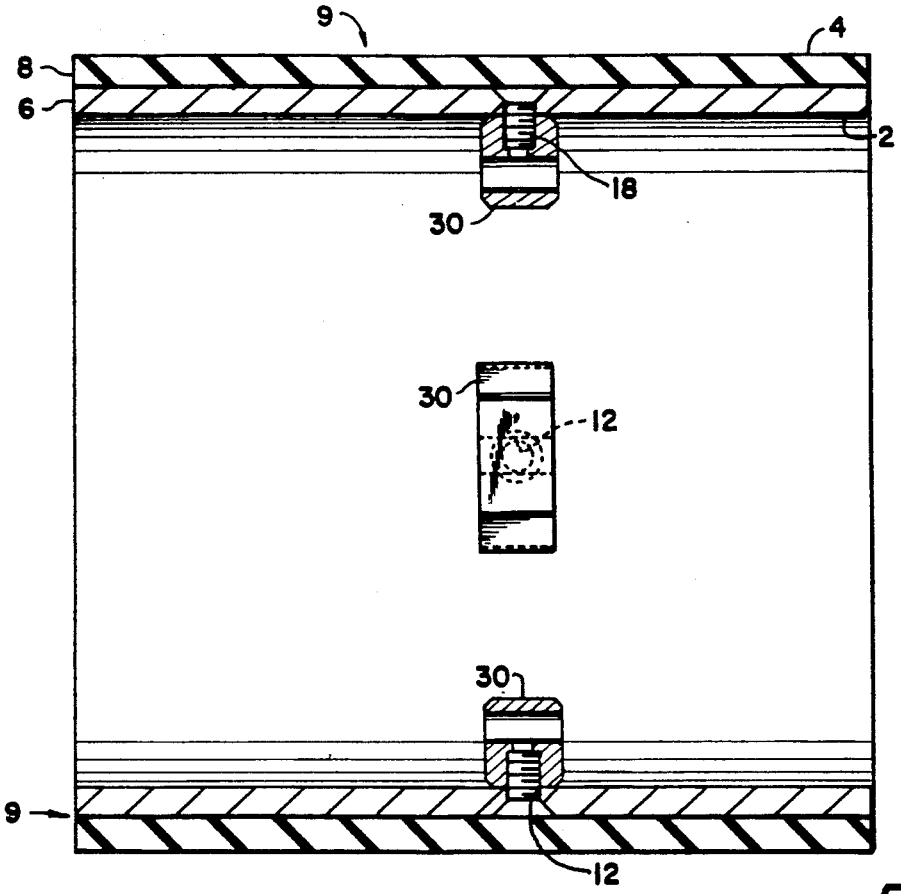
FIG. 1 is a centerline sectional view of one form of a roller sleeve assembly made in accordance with a method illustrative of an embodiment of the invention.

Referring to FIG. 1 of the drawings, it will be seen that an illustrative embodiment of the invention includes a first round tubular sleeve 2 which is of a rigid material, preferably a metal of high thermal conductivity, such as aluminum. Bonded to the lengthwise exterior surface of the first sleeve 2 is a second sleeve 4 of a hard flexible material, preferably a polymer, such as polyurethane. The two sleeves 2, 4 are coextensive, that is, they are of equal length and precisely aligned such that their respective ends 6, 8 are flush with each other to provide essentially a laminate sleeve assembly 9.

The metal sleeve 2 is provided with counter sunk recesses 12 which extend radially through the metal sleeve. The counter sunk recesses 12 of the metal sleeve 2 are fitted with threaded flat head screws 18 (FIGS. 1 and 5) extending inwardly of the metal sleeve, beyond the interior surface of the metal sleeve, and having heads disposed in recesses in the exterior surface of the metal sleeve. The counter sunk recesses 12 are closed at one end by the interior surface of the second sleeve, thereby capturing the screws 18.

In fabrication of the sleeve assembly 9, the counter sunk recesses 12 are drilled radially through the metal sleeve 2. The screws 18 are then inserted into the counter sunk recesses 12. Locking lugs 30, having threaded recesses 34, are then threadably fixed to the interior surfaces of the metal sleeve by way of connection to the screws 18. In bonding the flexible material sleeve 4 to the metal sleeve 2, the heads of the screws 18 are covered by flow of the flexible material thereover. Upon completion of the bonding step, the screws 18 are securely fixed to the metal sleeve 6.

Figure 2:
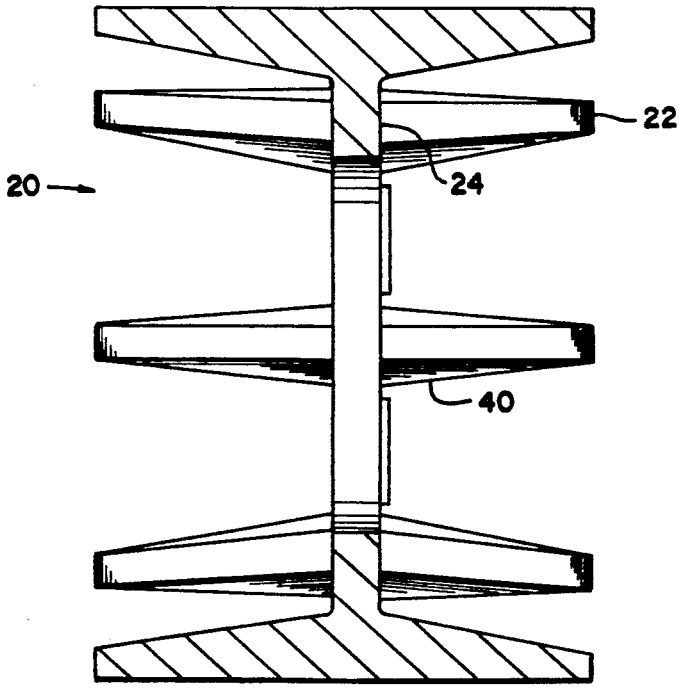
FIG. 2 is a centerline sectional view of a hub component of a roller assembly made in accordance with a method illustrative of an embodiment of the invention.
Figure 3:
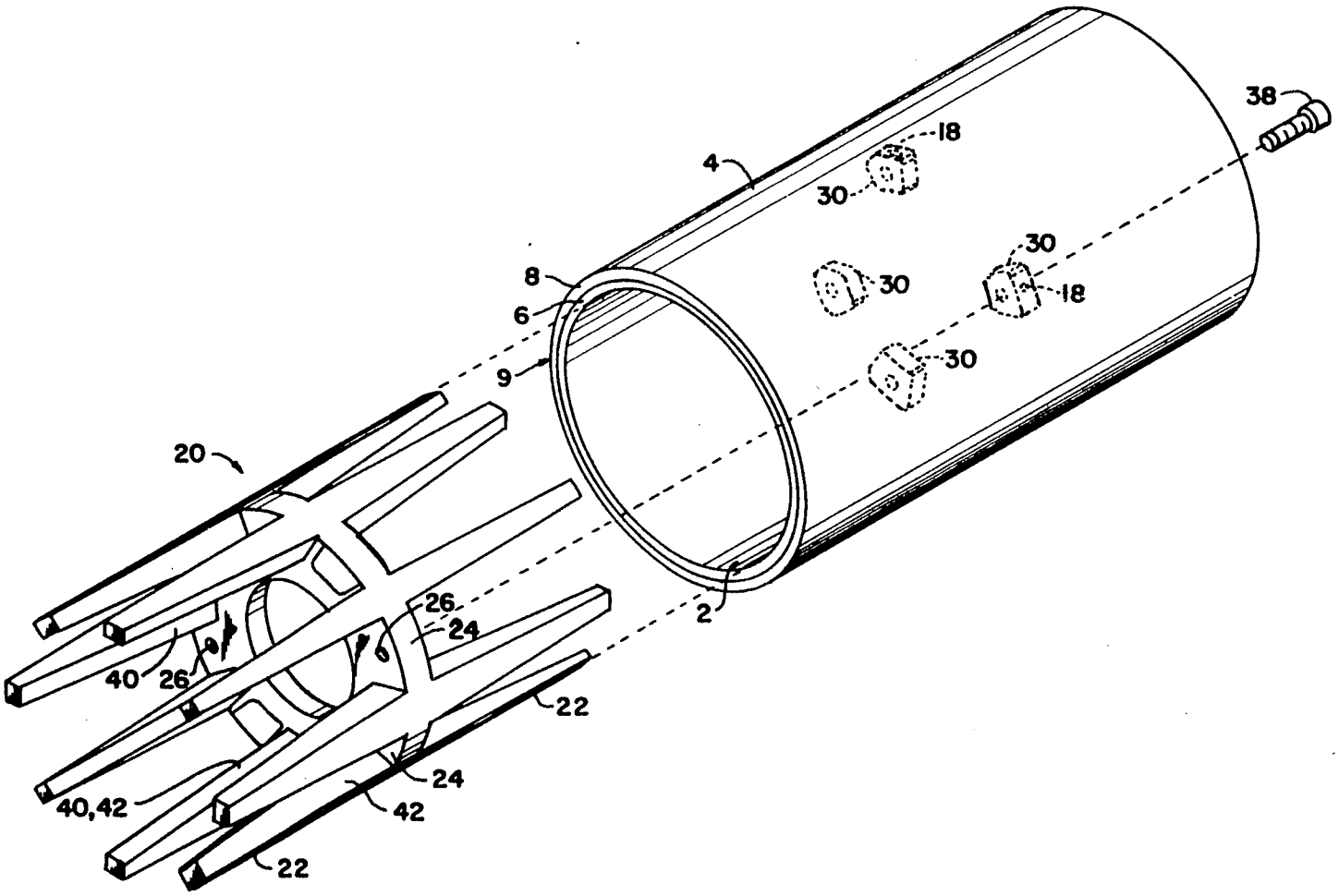
FIG. 3 is an exploded perspective view showing a roller assembly including the components shown in FIGS. 1 and 2.
Figure 5:
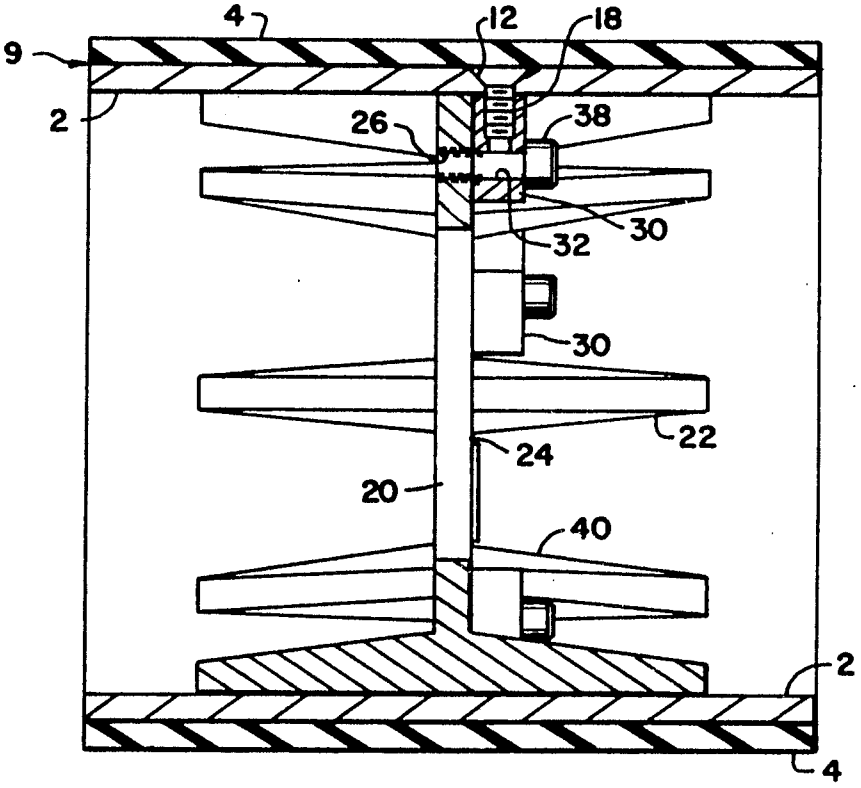
FIG. 5 is a sectional view taken along line V—V of FIG. 4.
Figure 4:
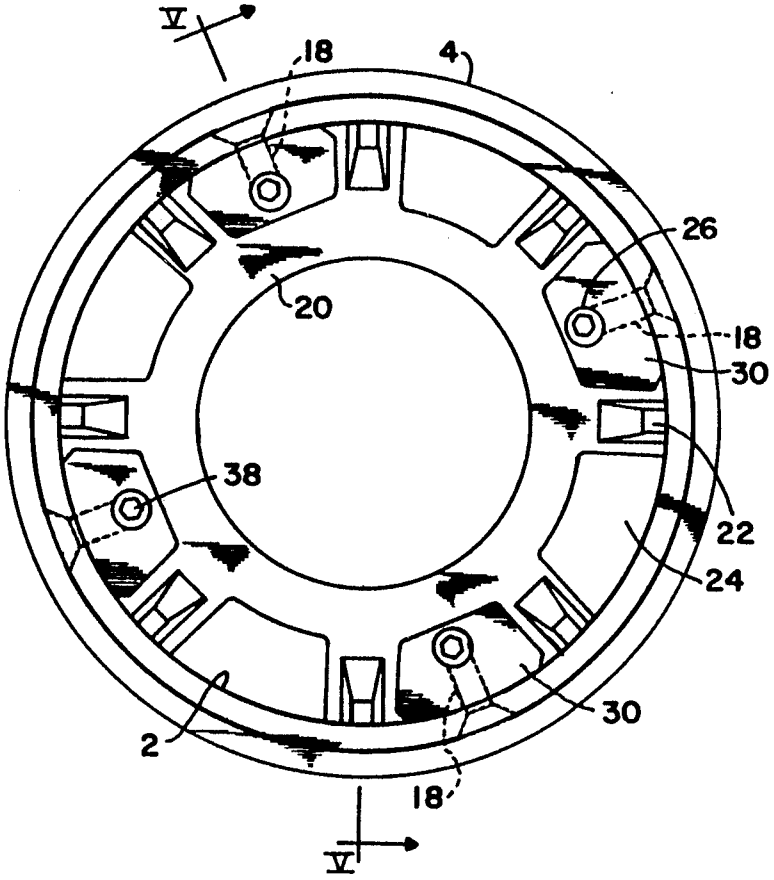
FIG. 4 is an end view of the roller assembly of FIG. 3.
Figure 6:
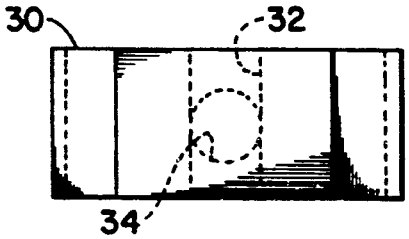
FIG. 6 is a top view of a locking lug for the roller sleeve assembly.
Figure 7:
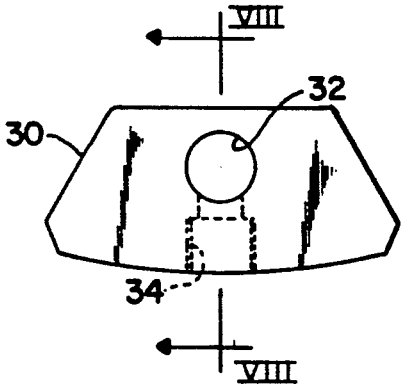
FIG. 7 is a front elevational view of the locking lug shown in FIG. 6.
Figure 8:
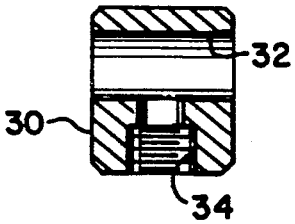
FIG. 8 is a sectional view of the locking lug, taken along line VIII—VIII of FIG. 7.

The mounting means comprises a mounting hub 20 (FIG. 2) having a series of ribs 22 extending from a circular, preferably annular, wall 24. The ribs 22 are arranged in a spaced circular configuration so as to be adapted to slidably receive the metal sleeve 2 exteriorly of the ribs 22 (FIG. 3). The wall 24 extends widthwise and substantially normally of the axially extending ribs. The wall 24 is provided with axially extending holes 26 (FIGS. 3 and 5).

The afore-mentioned locking lugs 30 (FIGS. 1, 3–5) are adapted to lock the metal sleeve 2 to the wall 24. The locking lugs 30 are provided with holes 32 adapted for alignment with the wall holes 26. The locking lugs 30 may be connected to the wall 24 by bolts 38 extending through the locking lug holes 32 and the wall holes 26 (FIGS. 3 and 5). Thus secured, the sleeve assembly 9 is fixed to the mounting hub 20 such that there can be no longitudinal or rotational movement of the sleeves relative to the hub.

As noted above, the ribs 22 protrude axially from the wall 24 and define a circumference adapted to slidably receive the metal sleeve 2. As such, the ribs 22 serve as a critical part of the mounting hub, the part upon which the sleeve 2 is mounted. The ribs 22 are formed so as to perform a second valuable function. One or more of the ribs 22 are provided with a shaped portion 40 (FIG. 3) increasing the area of the rib and providing vane means 42 internally of the assembly. In rotation of the sleeve assembly, the vane means 42 operate to create air turbulence centrally of the assembly, to assist in cooling the metal sleeve 2 and the flexible sleeve 4 indirectly by cooling of the metal sleeve. In the embodiment illustrated, the vane means 42 comprise the portions 40 of the ribs 22, the portions 40 extending from the wall 24 and the ribs 22. However, it will be apparent that the vane means 42 could comprise surfaces extending from the wall 24 or the ribs 22 and independent of the other.

In operation, when the flexible sleeve has deteriorated to the point at which replacement is required, the roller assembly is stopped. The bolts 38 are withdrawn from the holes 26, 32 and the locking lugs 30, and worn sleeve assembly 9 are slid off the mounting hub 20. A new sleeve assembly, complete with locking lugs, is slid onto the ribs 22 of the mounting hub. The holes 26, 32 are aligned and a bolt 38 is inserted in the holes 26, 32 and secured therein. The process is repeated for each locking lug, taking only a few seconds per lug. The process is then repeated for the other roller assembly of a twin roller assembly and the apparatus is ready to resume operations.

In use of the aforementioned prior art rubber-surfaced rolls, it has been the custom to have the rubber sleeves of a relatively large (about one inch) wall thickness, in the expectation that because of rapid wear a wall thickness of an inch, or more, will provide substantial longevity before wearing out of the roll surface. However, it has been determined that a contributing factor to rapid wear of the rubber sleeves is the heat generated at the roll surface, which heat is not readily dissipated. It has been discovered that longevity can be enhanced by making the outer sleeve 4 of polyurethane and, rather than having a relatively thick walled sleeve, provide a relatively thin walled sleeve. The thin walled polyurethane sleeve 4 conducts heat rapidly to the metal sleeve 2 and thence to the atmosphere.

It has been found that a polyurethane sleeve thickness of about 0.5 inch, used in conjunction with an aluminum metal sleeve having a wall thickness of about 0.312 inch, provides a heat conduction rate in BTU/hour approximately twice the heat conduction rate of a one inch rubber sleeve used in conjunction with the same metal sleeve. A polyurethane sleeve having a wall thickness of 0.375 inch increases the heat conduction rate to almost three times that of the prior art one inch sleeve. The thinner sleeves, with higher heat conduction rates, actually provide increased life expectancy of the rolls, rather than a decreased active period, as has generally been believed.

Accordingly, using the above-described vane means 42 in conjunction with the increased cooling capacity as a result of providing a relatively thin-walled flexible outer sleeve 4, contributes to a long-lived roller sleeve assembly 9 which substantially increases the life of the roller assembly. When replacement does fall due, the above-described locking lugs 30 offer quick and easy replacement.

It is to be understood that the present invention is by no means limited to the particular methods of construction herein disclosed and/or shown in the drawings, but also comprises any modifications or equivalents within the scope of the claims.

Having thus described our invention, what we claim as new and desire to secure by Letters Patent of the United States is:

1. A method for making a roller assembly, the method comprising providing a round, tubular, rigid metal sleeve, forming counter sunk recesses extending radially through said metal sleeve, fixing screws in said counter sunk recesses with head portions of said screws recessed in an exterior surface of said metal sleeve and with shank portions of said metal screws extending inwardly of said metal sleeve, detachably fixing locking lugs on the interior surface of said metal sleeve by threadably connecting locking lugs to said screws, said locking lugs extending radially inwardly of said metal sleeve and defining an interrupted annular collar on the interior circumference of said metal sleeve, and bonding a sleeve of flexible material to the entire lengthwise exterior surface of said metal sleeve, thereby providing a laminate sleeve assembly with locking lugs fixed thereto, providing a mounting hub assembly comprising a circular wall having ribs extending from said wall and substantially normal thereto, sliding said metal sleeve onto said ribs until said wall abuts said annular collar, and fixing said locking lugs to said wall, thereby connecting said sleeve assembly to said mounting hub.

2. The method for making a roller assembly in accordance with claim 1 in which said sleeve of flexible material is formed of polyurethane and provided with a wall thickness of about 0.375 to 0.5 inch.

3. The method for making a roller assembly in accordance with claim 2 in which said metal sleeve is formed of aluminum and provided with a wall thickness of bout 0.3 inch.

4. The method for making a roller assembly in accordance with claim 1 in which said wall is of an annular configuration.

5. The method for making a roller assembly in accordance with claim 4 i which said ribs are provided extending form said annular wall to define a circumference adapted to slidably receive said first sleeve, and portions of said ribs are formed extending inwardly of said assembly to form vane means.

6. The method for making a roller assembly according to claim 1, wherein said ribs of said mounting hub assembly are interconnected only at said circular wall.

7. A method for making a roller assembly, the method comprising providing a rigid metal sleeve, forming counter sunk recesses extending radially through said metal sleeve, fixing screws in said counter sunk recesses with head portions of said screws recessed in an exterior surface of said metal sleeve and shank portions of said screws extending inwardly of said metal sleeve, threadably fixing a locking lug to each of said screws by threadably connecting said locking lugs to said shank portions of said screws, on an interior surface of said metal sleeve, bonding a sleeve of flexible metal to the substantially entire lengthwise exterior surface of said metal sleeve, said flexible material sleeve covering said screw head portions, providing amounting hub assembly comprising a circular wall having ribs extending therefrom, said ribs being interconnected only at said circular wall and being disposed in circular fashion and adapted to slidingly receive said metal sleeve, and adapted to receive said locking lugs therebetween, and fixing said locking lugs to said circular wall thereby locking said metal sleeve to said mounting hub.

* * * * *